US005731276A

United States Patent [19]

Argo et al.

[11] Patent Number: 5,731,276

[45] Date of Patent: Mar. 24, 1998

[54] THICKENED AQUEOUS CLEANING COMPOSITION AND METHODS OF PREPARATION THEREOF AND CLEANING THEREWITH

[75] Inventors: Brian P. Argo, Tracy; Clement K. Choy, Alamo, both of Calif.

[73] Assignee: The Clorox Company, Oakland, Calif.

[21] Appl. No.: 688,563

[22] Filed: Jul. 30, 1996

[51] Int. Cl.[6] ..... C11D 3/04; C11D 3/395

[52] U.S. Cl. ..... 510/284; 510/303; 510/341; 510/355; 510/356; 510/357; 510/379; 510/380; 510/508

[58] Field of Search ..... 510/284, 303, 510/341, 350, 351, 355, 356, 357, 379, 380, 508

[56] References Cited

U.S. PATENT DOCUMENTS

| | | | |
|---|---|---|---|
| 1,871,781 | 8/1932 | Crow et al. | 106/795 |
| 2,570,532 | 10/1951 | Eisenberg et al. | 424/601 |
| 3,540,891 | 11/1970 | Muhler et al. | 510/238 |
| 3,709,823 | 1/1973 | Suguhara et al. | 510/531 |
| 4,208,295 | 6/1980 | Sai et al. | 510/315 |
| 4,259,200 | 3/1981 | Sims et al. | 510/376 |
| 4,271,030 | 6/1981 | Brierley et al. | 252/187.26 |
| 4,388,204 | 6/1983 | Dimond et al. | 510/195 |
| 4,431,559 | 2/1984 | Ulrich | 510/221 |
| 4,438,016 | 3/1984 | Kiewert et al. | 510/369 |
| 4,585,570 | 4/1986 | Nelson | 252/187.26 |
| 4,599,186 | 7/1986 | Choy et al. | 510/369 |
| 4,657,692 | 4/1987 | Choy et al. | 510/369 |
| 4,695,394 | 9/1987 | Choy et al. | 510/369 |
| 4,752,409 | 6/1988 | Drapier et al. | 510/222 |
| 4,842,757 | 6/1989 | Reboa et al. | 510/370 |
| 4,919,841 | 4/1990 | Kamel et al. | 510/375 |
| 4,970,016 | 11/1990 | Ahmed et al. | 510/221 |
| 5,057,237 | 10/1991 | Drapier et al. | 510/222 |
| 5,089,161 | 2/1992 | Ahmed et al. | 510/221 |
| 5,209,863 | 5/1993 | Dixit et al. | 510/370 |
| 5,346,641 | 9/1994 | Argo et al. | 510/369 |
| 5,384,061 | 1/1995 | Wise | 510/370 |
| 5,510,047 | 4/1996 | Gabriel et al. | 510/221 |

FOREIGN PATENT DOCUMENTS

| | | |
|---|---|---|
| 2902236 | 7/1979 | Germany . |
| WO9405758 | 3/1994 | WIPO . |
| WO9416808 | 8/1994 | WIPO . |

*Primary Examiner*—Paul Lieberman
*Assistant Examiner*—Caroline L. Duschek
*Attorney, Agent, or Firm*—Majestic, Parsons, Siebert & Hsue

[57] ABSTRACT

The present invention provides an abrasive-free cleaning composition which includes, in aqueous solution, a bleach, a colloidal thickener, and a source of divalent ionic calcium. The composition further includes at least one surfactant which is effective to provide cleaning activity and, in association with the colloidal thickener, thickening. The composition also includes an electrolyte/buffer which is effective to promote an environment in which the thickener and the surfactant associate to provide proper thickening. The inventive cleaning composition, with its ionic calcium source, has desirable viscosity and rheological properties, and demonstrates significant viscosity stability, rheological stability, phase stability and bleach stability. The cleaning composition maintains these desirable properties under typical storage conditions as well as over extended times and at elevated temperatures. The present invention also provides a method of preparing an abrasive-free cleaning composition and a method of cleaning a substrate with an abrasive-free cleaning composition.

29 Claims, 5 Drawing Sheets

THICKENED AQUEOUS CLEANING COMPOSITION AND METHODS OF PREPARATION THEREOF AND CLEANING THEREWITH

FIELD OF THE INVENTION

The present invention relates generally to an abrasive-free, thickened aqueous cleaning composition which contains a colloidal thickener and a bleach source. More particularly, this invention relates to such a composition which includes a source of ionic calcium and has desirable viscosity, rheological properties, phase stability and bleach stability. The present invention also relates to a method of preparing the composition and a method of using the composition for cleaning.

BACKGROUND OF THE INVENTION

Cleaning compositions which include an abrasive component are well known. Typically, these abrasive cleansers are used in the cleaning, or scouring, of hard surfaces.

Abrasive cleansers must be formulated such that the abrasive, such as calcium carbonate, is stably suspended therein. In the formulation of such cleansers, attempts to suspend the abrasive stably have often resulted in rheological problems, for example, an unacceptable increase in thickening over time, and/or syneresis problems, whereby the solids portion and the liquids portion of the composition separate over time. When such abrasive compositions include a bleach component, attempts to suspend the abrasive stably have often resulted in an additional problem of bleach instability.

Thickened aqueous cleaning compositions which include a bleach and stably suspend abrasives have been developed. See Choy et al., U.S. Pat. Nos. 4,599,186 (issued Jul. 8, 1986), 4,657,692 (issued Apr. 14, 1987), and 4,695,394 (issued Sep. 22, 1987) and Argo et al., U.S. Pat. No. 5,346,641 (issued Sep. 13, 1994). For example, Choy et al. teach abrasive, bleach-containing, hard-surface cleansers in which an inorganic colloid thickener, namely, alumina, is combined with a surfactant/electrolyte system to provide good physical stability. Further by way of example, Argo et al. disclose an abrasive, hard-surface cleanser which includes an alumina thickener, a surfactant for providing desirable rheological properties and cleaning, an electrolyte/buffer, a halogen bleach, a particulate abrasive, and a viscosity-stabilizing amount of a multivalent salt. The abrasive, hard-surface cleanser of Argo et al. provides good abrasive suspension capability and viscosity stability and exhibits plastic flow. Plastic flow is often desirable in a thickened cleaning composition, so that, for example, shearing of the composition is not required to promote fluidity appropriate for use.

Abrasive-free cleaning compositions are generally more easy to formulate than abrasive cleansers, as the burden of stably suspending an abrasive and the problems associated therewith are removed. Abrasive-free cleaning compositions and methods associated therewith are subjects of the present invention.

Liquid or gel detergent cleaning compositions which include gelling or stabilizing agents, but do not include abrasives or bleach, are known. See Beggs et al., Vista Chemical Company, International Publication No. WO 94/16808 (Published Aug. 4, 1994); and Dyet et al., The Procter & Gamble Company, International Publication No. WO 94/05758 (Published Mar. 17, 1994). For example, Beggs et al. disclose an alumina-thickened detergent composition which contains a gelling agent. In the Beggs et al. composition, the alumina is present in an amount sufficient to render the composition thixotropic, while the gelling agent is said to flocculate the alumina or to cause the alumina to gel. The thixotropic character of the Beggs et al. composition differs significantly from the plastic flow character (above) desirable in a thickened cleaning composition.

Further by way of example, Dyet et al. disclose a liquid or gel detergent composition which includes non-ionic surfactant, anionic sulfate and/or anionic sulfonate surfactant, calcium and/or strontium ions, and a stabilizing agent selected from malic acid, maleic acid and/or acetic acid. Dyet et al. describe calcium as being useful in a detergent composition containing polyhydroxy fatty acid amide for the cleaning of greasy soils. However, calcium is known to be difficult to formulate into a stable liquid composition. Dyet et al. thus employ stabilizing agents, namely, malic, maleic, and/or acetic acid, which are needed to stabilize the calcium or strontium ions of their composition. While Dyet et al. disclose these acids as being useful stabilizing agents in their bleach-free composition, such acids would have a detrimental effect on bleach stability in a composition employing a bleach component such as, for example, a halogen bleach.

Ahmed et al. disclose a thixotropic, aqueous, liquid automatic dishwashing detergent composition which may contain a bleach component. See Ahmed et al., U.S. Pat. Nos. 4,970,016 (issued Nov. 13, 1990) and 5,089,161 (issued Feb. 18, 1992). In addition to a bleach component, Ahmed et al.'s detergent composition includes a thixotropic thickener and an anti-filming agent of alumina or titanium dioxide. The thixotropic thickener may be an organic fatty acid or fatty acid polyvalent metal salt and/or an inorganic colloid-forming clay material. The anti-filming component of the Ahmed et al. composition is said to reduce filming on dishware and glassware in dishwashing applications. As the Ahmed et al. composition is thixotropic, it does not exhibit the plastic flow character desirable in a thickened cleaning composition.

There remains a need for an abrasive-free, thickened aqueous cleaning composition, including a bleach and a colloidal thickener, which has desirable viscosity, plastic flow, phase stability and bleach stability.

SUMMARY OF THE INVENTION

It is an object of the present invention to provide an abrasive-free, thickened aqueous cleaning composition which exhibits desirable viscosity, plastic flow, phase stability and bleach stability. It is a further object of the invention to provide a method of preparing such a composition and a method of cleaning a substrate using such a composition.

These and other objects are achieved by the present invention which provides an abrasive-free, cleaning composition which includes, in aqueous solution, a bleach, a colloidal thickener, and a source of divalent ionic calcium. The composition further includes at least one surfactant which is effective to provide cleaning activity and, in association with the colloidal thickener, thickening. The composition also includes an electrolyte/buffer which is effective to promote an environment in which the thickener and the surfactant associate to provide proper thickening.

In the formulation of the abrasive-free cleaning composition of the present invention, it was discovered that the inventive cleaning composition, which includes a source of ionic calcium, exhibits properties which are particularly desirable in thickened aqueous cleaning compositions. For example, the inventive cleaning composition evidences the following advantageous properties: (1) an initial increase in the viscosity of the composition, the viscosity remaining substantially stable over time; (2) desirable rheological properties, or plastic flow, the plastic flow character of the composition remaining substantially stable over time; (3) phase stability, or a lack of syneresis; and (4) bleach stability.

The foregoing advantageous properties of the inventive cleaning composition appear to be attributable to the inclusion of the ionic calcium source component. This discovery is surprising in that, generally, in previous cleaning composition formulations, ionic calcium was not entertained as a possible ingredient based on expectations of its undesirable precipitation, or formation of soap scum, its undesirable effect on the rheological properties of the composition, and/or its undesirable effect on the stability of the composition.

The abrasive-free composition of the present invention exhibits an initial viscosity which is greater than that which is provided by the association of its thickener and surfactant components alone. The viscosity of the composition can be adjusted, so that the composition is neither too thick nor too thin, by adjusting the amount of the ionic calcium source. So adjusted, the viscosity of the inventive composition remains stable over time and at elevated temperature. In addition to these desirable viscous properties, the inventive composition exhibits desirable rheological properties of plastic flow. The inventive composition also provides rheological stability and phase stability, while maintaining bleach stability.

The foregoing advantages of the inventive composition may be obtained when only trace or small amounts of ionic calcium are present. For example, according to one aspect of the present invention, a substantially water soluble source of divalent ionic calcium provides ionic calcium in an amount from about 0.0001 to about 1.0 weight percent of the composition, or preferably, in an amount from about 0.0001 to about 0.34, or more preferably, in an amount from about 0.0007 to about 0.07 weight percent of the composition. Thus, the inventive composition may be economically formulated.

The composition of the present invention is useful for a variety of cleaning applications. By way of example, the inventive composition is useful for laundry applications, such as the pre-laundering application of the composition to fabrics, the use of the composition in a laundering application, and the like, as well as surface cleaning applications, such as the cleaning of tiles, porcelain, floors, bathroom walls, sinks, tubs, toilets, and the like.

Additional objects, advantages and features of the various aspects of the present invention will become apparent from the following description of its preferred embodiments, which description should be taken in conjunction with the accompanying drawings.

DESCRIPTION OF PREFERRED EMBODIMENTS

Figure 1:
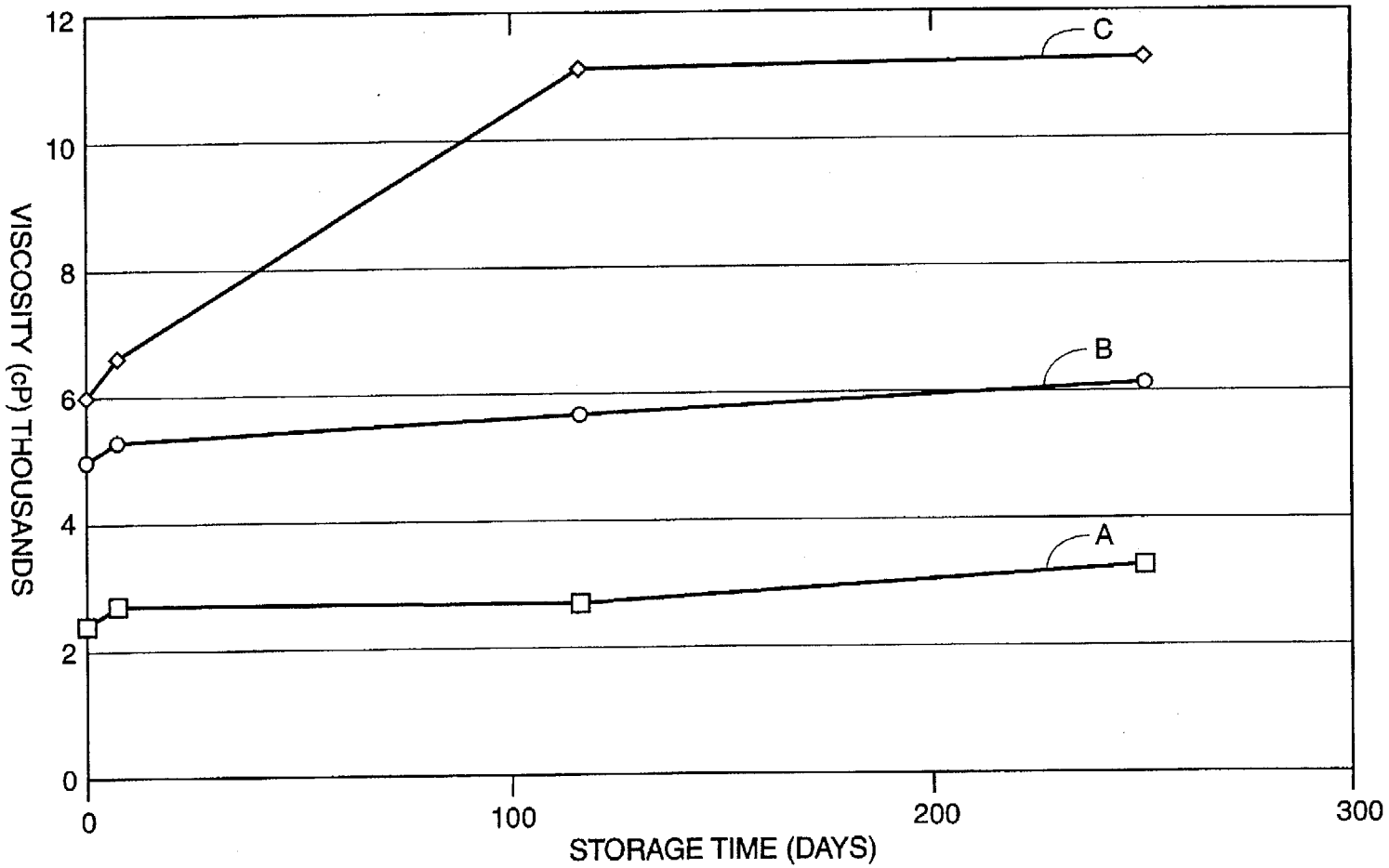
FIG. 1 is a graph showing viscosity stability at 70 degrees Fahrenheit (°F.) for one composition having no ionic calcium, and two compositions having various concentrations of ionic calcium according to the present invention, wherein the ordinate represents viscosity in thousands of centipoise (cP) and the abscissa represents storage time in days.

The present invention provides an abrasive-free cleaning composition having no significant syneresis, no undue viscosity or yield stress increase, and excellent bleach stability. All of the foregoing advantages are present over time and upon storage at elevated temperature.

According to one aspect of the present invention, an alkaline, abrasive-free, cleaning composition is provided, the composition comprising, in aqueous solution: a colloidal aluminum oxide thickener; at least one surfactant, the surfactant alone, or a plurality of surfactants together, effective to provide cleaning activity and, in association with said alumina thickener, thickening; an electrolyte/buffer effective to promote an environment in which the alumina thickener and the surfactant associate to provide thickening; a halogen bleach; and, a substantially water soluble source of divalent ionic calcium. The source of divalent ionic calcium provides ionic calcium in an amount sufficient to provide an initial viscosity greater than that provided by the association of the alumina thickener and the surfactant, to provide rheological stability and phase stability, and to maintain bleach stability. The present invention thus provides an abrasive-free, bleach-containing cleaning composition which is very stable, both physically and in cleaning efficacy.

According to another aspect of the present invention, an alkaline, abrasive-free, cleaning composition is provided, the composition comprising, in aqueous solution: the colloidal aluminum oxide thickener, the at least one surfactant, the electrolyte or buffer, and the halogen bleach, all as described above; a fatty acid soap; and, a substantially water soluble source of divalent ionic calcium which provides ionic calcium in an amount from about 0.0001 to about 1.0 weight percent of the composition. Preferably, the source provides ionic calcium in an amount from about 0.0001 to about 0.34, and more preferably, in an amount from about 0.0007 to about 0.07 weight percent of the composition. Thus, the abrasive-free, bleach-containing composition of the present invention may be formulated economically, using only trace or small amounts of ionic calcium.

The individual components of the inventive cleaning compositions are described more particularly below. As used herein, unless otherwise specified, the term "effective amount" means an amount sufficient to accomplish the intended purpose, e.g., thickening, cleaning, and other purposes, and the term "half-life", when used in terms of a bleach component or the stability thereof, refers to the amount of time it takes for 50% of the initial amount of bleach present in the composition to decompose.

Colloidal Thickener

The colloidal thickening component of the invention composition is provided by an alumina, or hydrated aluminum oxide, which is present in an amount of from about 0.1 to about 25 weight percent of the composition, and preferably, in an amount of from about 0.1 to about 10 weight percent of the composition. A typical alumina is DISPURAL, distributed by Remet Chemical Corp., Chadwicks, N.Y., and manufactured by Condea Chemie, Brunsbuettel, West Germany. DISPURAL is an aluminum oxide monohydrate which forms stable colloidal aqueous dispersions.

These particular types of alumina are dry powders which can form thixotropic gels, bind silica and other ceramic substrates, possess a positive charge when dissolved in acidic media, and are substantive to a variety of surfaces. DISPURAL has a typical chemical composition of 90% alpha aluminum oxide monohydrate (boehmite), 9% water, 0.5% carbon (as primary alcohol), 0.008% silicon dioxide, 0.005% ferric oxide, 0.004% sodium silicate, and 0.05% sulfur. DISPURAL has a surface area (BET) of about 320 $m^2$/gm, an average particle size (as determined by sieving) of 15% greater than 45 microns and 85% less than 45 microns, an X-ray diffraction dispersion of 0.0048 micron, and a bulk density of 45 lbs./ft.$^3$ loose bulk and 50 lbs./ft.$^3$ packed bulk.

Another commercial source of alumina suitable for use is CATAPAL Alumina, manufactured by the Vista Chemical Company, Houston, Tex. CATAPAL SB has a typical chemical composition of 74.2% aluminum oxide (boehmite), 25.8% water, 0.36% carbon, 0.008% silicon dioxide, 0.005% ferric oxide, 0.004% sodium oxide, and less than 0.01% sulfur. CATAPAL SB has a surface area (BET) of 280 $m^2$/gm, an average particle size (as determined by sieving) of 38% less than 45 microns and 19% greater than 90 microns. CATAPAL D has a chemical composition of about 73% alumina, 0.15% carbon, 0.01% silicon dioxide, 0.01% ferric oxide, 0.03% titanium dioxide and 26.8% water. CATAPAL D has a BET surface area of about 220 $m_2$/gm and an average particle size distribution of 35% less than 45 microns, and 17% greater than 90 microns.

These colloidal alumina thickeners generally have exceedingly small average particle size (i.e., generally 90% are less than 50 microns in average particle size) and have an average particle size diameter of less than 40 microns, more preferably less than 30 microns, and most preferably less than 25 microns. The average measured particle size diameter of these thickeners, as supplied, is likely to be around 1 to 10 microns. In dispersion, however, the average particle size of these aluminas is less than about one micron.

Because of their small size, little or substantially no abrasive action is provided by these types of alumina particles even though they are inorganic and chemically insoluble. Additionally, the preferred hydrated aluminas are derived from a mineral, boehmite (typically found in bauxite ore deposits), which has a Mohs hardness of about 3, representing a relative softness which substantially mitigates any abrasive action provided by these aluminas.

An important aspect of the hydrated aluminas used herein is that they must be chemically insoluble, i.e., they must not dissolve in acidic, basic or neutral media in order to have effective thickening as well as stability properties. Neutralization of acidified colloid is necessary to obtain the desired rheological properties of the product. Additionally, neutralization is desirable because the halogen bleach component of the cleaning composition of this invention is unstable in the presence of acid. Thus, acidified, diluted colloid is neutralized, preferably using sodium hydroxide (e.g., a 50% solution). It may be possible to forego sodium hydroxide as a separate component if the electrolyte/buffer is sodium carbonate or sodium silicate. Further, while an alkaline neutralizing agent may be added separately, it is possible to use an anionic surfactant as a carrier therefor.

With respect to thickening, it should be noted that while there are many types of inorganic and organic thickeners, not all of these thickeners will provide plastic flow, a rheological property desired in the present invention. Common clays, for instance, will likely lead to a false body rheology and, at rest, will likely become very viscous. A thixotropic rheology is also not desirable in this invention because in the thixotropic state, a liquid at rest also thickens dramatically. If the thixotrope has a yield stress value such as that typically found in clay-thickened liquid media, the fluid at rest may not return to a flowable state without shaking or agitation. Even if colloidal alumina alone is used as the thickener, a thixotrope with a high yield stress value appears to result.

In the cleaning composition of the present invention, the surfactant component, as described below, is important in achieving the desired creamy, plastic rheology. The inventive composition, with its plastic flow characteristics, does not require shearing to promote fluidity. Thus, the cleaning composition of this invention generally does not require squeezing, shaking or agitation to flow out of the container or dispenser.

Surfactant

The surfactant suitable for use in this invention is selected from anionic, non-ionic, amphoteric, zwitterionic surfactants and mixtures thereof. It is especially preferred to use a combination of anionic and bleach-stable, non-ionic surfactants.

The anionic surfactant is selected from bleach-stable surfactants such as alkali metal alkyl sulfates, secondary alkane sulfonates (also referred to as paraffin sulfonates), alkyl diphenyl ether disulfonates, fatty acid soaps, and mixtures thereof. Such an anionic surfactant will preferably have alkyl groups averaging about 8 to about 20 carbon atoms. In practice, any other anionic surfactant which does not degrade chemically when in contact with a hypohalite, e.g., hypochlorite, bleaching species should also work.

An example of a particularly preferred secondary alkane sulfonate is HOSTAPUR SAS, manufactured by Farbwerke Hoechst A.G., Frankfurt, West Germany. Examples of typical alkali metal salts of alkyl benzene sulfonic acids are those manufactured by Pilot Chemical Company sold under the trademark CALSOFT. An example of a typical alkali metal alkyl sulfate is CONCO SULFATE WR, sold by Continental Chemical Company which has an alkyl group of about 16 carbon atoms. When the electrolyte used is an alkali metal silicate, it is most preferable to include a soluble alkali metal soap of a fatty acid, such as a $C_{6-14}$ fatty acid soap. Especially preferred are sodium and potassium soaps of lauric and myristic acid. When used as a component of the inventive cleaning composition, the alkali metal soap of a fatty acid is present in an amount from above zero to about 10 weight percent of the composition.

Examples of preferred bleach-stable, non-ionic surfactants are amine oxides, especially trialkyl amine oxides, as represented below.

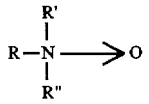

In the structure above, R' and R" may be alkyls of 1 to 3 carbon atoms and are most preferably methyls, and R is an alkyl of about 10 to 20 carbon atoms. When R' and R" are both methyl and R is alkyl averaging about 12 carbon atoms, the structure for dimethyldodecylamine oxide, a particularly preferred amine oxide, is obtained. Representative examples of these particular types of bleach-stable, non-ionic surfactants include the dimethyldodecylamine oxides sold under the trademark AMMONYX LO by Stepan Chemical. Yet other preferred amine oxides are those sold under the trademark BARLOX by Lonza, CONCO XA sold by Continental Chemical Company, AROMAX sold by Akzo, and SCHERCAMOX, sold by Scher Brothers, Inc. These amine oxides preferably have main alkyl chain groups averaging about 10 to about 20 carbon atoms.

Other types of suitable surfactants include amphoteric surfactants such as, for example, betaines, imidazolines and certain quaternary phosphonium and tertiary sulfonium compounds.

It is particularly preferred to combine at least two surfactants, most preferably the anionic and the bleach-stable, non-ionic surfactants. Combinations of these types of surfactants appear to be particularly favorable for maintaining hypochlorite half-life stability at elevated temperatures for long periods of time. In the inventive composition, total surfactant is present in an amount ranging from about 0.1 to about 20 weight percent of the composition.

Determining an appropriate mixture of alumina and surfactant is very important to the invention. Use of alumina, by itself, provides a composition with unacceptable syneresis, while use of a mixed surfactant system, alone, and in high amounts, results in reduced bleach half-life. Theoretically, alumina from about 0.1 to about 25 weight percent of the composition and total surfactant (anionic surfactant, bleach-stable, non-ionic surfactant, or mixtures thereof) from about 0.1 to about 20 weight percent of the composition may be used in the present invention, as long as proper rheology (plastic flow), desirable bleach stability, and lack of phase separation or syneresis result. In practice, it is preferred to use minimal quantities of alumina and surfactant. The amount that is ordinarily used is an amount that is effective for cleaning.

According to one aspect of the present invention, alumina and total surfactant may be used in the following ranges: alumina, preferably from about 0.1 to about 10 weight percent of the composition, and most preferably from about 0.5 to about 6 weight percent of the composition; and total surfactant, preferably from about 0.1 to about 20, and more preferably from about 0.5 to about 5 weight percent of the composition. The above-described ranges of alumina and surfactant appear to result in compositions having the desired syneresis values, optimal bleach half-lives, and, because of the reduced amount of actives in the compositions, lower overall manufacturing costs.

Electrolyte/Buffer

The electrolyte/buffer component of the cleaning composition appears to promote a favorable environment in which the alumina and the surfactant can combine. An electrolyte functions to provide a source of ions (generally anions) in aqueous solution. The electrolyte thus provides a charged medium in which the alumina thickener and the surfactant can associate to provide thickening, or the favorable plastic rheology of the invention. A buffer may act to maintain pH. In the present invention, alkaline pH is favored for purposes of both achieving desirable rheology and maintaining halogen bleach stability.

Some compounds will serve as both electrolyte and buffer. These particular electrolyte/buffer compounds are generally various inorganic acids, for example, polyphosphates, pyrophosphates, triphosphates, tetraphosphates, silicates, metasilicates, polysilicates, carbonates, and hydroxides; alkali metal salts of such inorganic acids; and mixtures of same. Certain divalent salts, e.g., alkaline earth salts of phosphates, carbonates, hydroxides, etc., can function singly as buffers. If such a divalent salt compound were used, it would be combined with at least one of the above-mentioned electrolyte/buffer compounds to provide the appropriate pH adjustment. It may also be suitable to use materials such as aluminosilicates (zeolites), borates, aluminates and bleach-stable organic materials, such as gluconates, succinates, and maleates, as buffers. Sodium chloride or sodium sulfate can be used as electrolytes, but not buffers, if necessary, to maintain the ionic strength necessary for the desired rheology.

An especially preferred electrolyte/buffer compound is an alkali metal silicate, which is employed in combination with an alkali metal fatty acid soap to provide the plastic rheology desired in this invention. The preferred silicate is sodium silicate, which has the empirical formula $NaO:SiO_2$. The ratio of sodium oxide: silicon dioxide is about 1:4 to 1:1, more preferably about 1:2. Silicates are available from numerous sources, such as PQ Corporation. The electrolyte/buffer compounds function to keep the pH range of the inventive cleaning composition preferably above 7.0, more preferably at between about 10.0 to about 14.0. The amount of electrolyte/buffer can vary from about 0.1 to about 25 weight percent of the composition, more preferably from about 0.1 to about 10 weight percent of the composition, and most preferably from about 0.5 to about 5 weight percent of the composition.

Halogen Bleach

A source of bleach is be selected from various halogen bleaches, which are particularly favored for the purposes of this invention. By way of example, the bleach may be, and preferably is, selected from the group consisting essentially of the alkali metal and alkaline earth salts of hypohalite, hypohalite addition products, haloamines, haloimines, haloimides and haloamides. These bleaches also produce hypohalous bleaching species in situ.

Preferred halogen bleaches include hypochlorite and compounds producing hypochlorite in aqueous solution, although hypobromite is another potential halogen bleach. Representative hypochlorite-producing compounds include sodium, potassium, lithium and calcium hypochlorite, chlorinated trisodium phosphate dodecahydrate (a hypohalite addition product), potassium and sodium dichloroisocyanurate, trichlorocyanuric acid, dichlorodimethyl hydantoin, chlorobromo dimethylhydantoin, N-chlorosulfamide (a haloamide), and chloramine (a haloamine). The halogen bleach is present in an amount from above zero to about 15 weight percent of the composition and preferably from about 0.5 to about 5 weight percent of the composition. A particularly preferred bleach in this invention is sodium hypochlorite, having the chemical formula NaOCl, present in an amount ranging from about 0.1 to about 15 weight percent of the composition, more preferably from about 0.1 to about 10 weight percent of the composition, even more preferably from about 0.25 to about 5 weight percent of the composition, and most preferably from about 0.5 to about 2 weight percent of the composition.

The purpose for the bleach is evident, as a bleach is known to be an oxidizing cleaning agent which is very effective against oxidizable stains, e.g., organic stains. The principle problem with bleach is also apparent, as it is known that when a bleach is combined with most actives in an aqueous system, oxidation occurs, and the bleaching efficacy may be greatly reduced. In a commercial setting, bleach stability is a necessary requirement to market a shelf-stable product that maintains its efficacy throughout its shelf-life. In the case of a hypochlorite bleach product, excessive decomposition of hypochlorite is detrimental because it produces oxygen gas which may cause pressure build-up in the product packaging, resulting in a foamy product.

In the present invention, it is particularly surprising that the bleach half-life is so excellent. It is believed, without being so bound, that the bleach stability of the inventive cleaning composition is attributable to the ionic calcium source component, as described below.

Source of Ionic Calcium

In the present invention, it has been surprisingly discovered that an ionic calcium component acts to increase the initial viscosity of the cleaning composition. Further, the inclusion of ionic calcium in the cleaning composition appears to result in the desirable compositional characteristics of viscosity stability, plastic flow, rheological stability, phase stability and bleach stability.

The inventive composition thus includes a substantially water-soluble source of divalent ionic calcium. For appropriate water solubility, the solubility product or $K_{sp}$ of the ionic calcium source is at least about $10^{-30}$, preferably about $10^{-10}$, and most preferably from $10^{-1}$ to about $10^{-2}$. The ionic calcium source may comprise calcium in ionic form or salt form. By way of example, the ionic calcium source may be, and preferably is, calcium chloride.

According to one aspect of the present invention, the ionic calcium source provides ionic calcium in an amount sufficient to provide an initial viscosity greater than that provided by the association of the alumina thickener and the surfactant, as described above, to provide rheological stability and phase stability, and to maintain bleach stability. According to another aspect of the present invention, the ionic calcium source provides ionic calcium in an amount from about 0.0001 to about 1.0 weight percent of the composition. Preferably, the ionic calcium source provides ionic calcium in an amount from about 0.0001 to about 0.34 weight percent of the composition. More preferably, the ionic calcium source provides ionic calcium in an amount from about 0.0007 to about 0.07 weight percent of the composition.

Without intending to be bound by theory, it is suggested that the calcium ions may preferentially interact with the alumina, surfactant, and/or electrolyte/buffer components of the composition, as opposed to anions present in the composition, such as hydroxide ions. Thus, it is suggested that the positively charged calcium ions may stabilize the alumina, surfactant, and/or electrolyte/buffer components of the composition. Unlike calcium ions, both magnesium ions and aluminum ions appear to have a greater affinity for the anions present in the composition than for the alumina, surfactant, and/or electrolyte/buffer components. It is believed that magnesium ions and aluminum ions thus ion-pair with anions, such as hydroxide ions, in the composition and thereby, lower the compositional pH and adversely effect the bleach stability of the composition. Magnesium and aluminum ions do not provide the advantages, for example, an increase in initial compositional viscosity, that appear to be attributable to the ionic calcium component of the present invention.

As described above, relatively small amounts of ionic calcium provide desirable compositional characteristics in terms of initial viscosity and viscosity stability, plastic flow and rheological stability, phase stability and bleach stability. Because only trace or small amounts of ionic calcium are employed, the cleaning composition can be produced economically.

Other Adjuncts

The composition of the present invention may be formulated to include further adjuncts, for example, fragrances, coloring agents, pigments (e.g., ultramarine blue), bleach-stable dyes (e.g., anthraquinone dyes), whiteners, solvents, chelating agents and builders, which enhance performance, stability or aesthetic appeal of the composition. Generally, such adjuncts may be added in relatively low amounts, e.g., each from about 0.001 to about 5.0 weight percent of the composition.

By way of example, a fragrance such as a fragrance commercially available from International Flavors and Fragrance, Inc., may be included in the inventive composition in an amount from about 0.01 to about 0.5 weight percent of the composition. Dyes and pigments may be included in small amounts, ultramarine blue (UMB) and copper phthalocyanines being examples of widely used pigments which may be incorporated in the composition of the present invention. Buffer materials, e.g. carbonates, silicates and polyacrylates may also be added, although such buffers should not be present in amounts which elevate the ionic strength of the compositions. Additionally, water may be added to the inventive cleaning composition to make up the balance of the composition.

Solvents may also be added to the inventive cleaning composition. For example, certain less water soluble or dispersible organic solvents, some of which are advantageously stable in the presence of hypochlorite bleach, may be included. These bleach-stable solvents include those commonly used as constituents of proprietary fragrance blends, such as terpene derivatives.

The terpene derivatives suitable for the present invention include terpene hydrocarbons with a functional group. Effective terpenes with a functional group include, but are not limited to, alcohols, ethers, esters, aldehydes and ketones. Representative examples of each of the above-mentioned terpenes with a functional group include, but are not limited, to the following: (1) terpene alcohols, including, for example, verbenol, transpinocarveol, cis-2-pinanol, nopol, iso-borneol, carbeol, piperitol, thymol, α-terpineol, terpinen-4-ol, menthol, 1,8-terpin, dihydroterpineol, nerol, geraniol, linalool, citronellol, hydroxycitronellol, 3,7-dimethyl octanol, dihydromyrcenol, β-terpineol, tetrahydroalloocimenol and perillalcohol; (2) terpene ethers and esters, including, for example, 1,8-cineole, 1,4-cineole, iso-bornyl methylether, rose pyran, α-terpinyl methyl ether, menthofuran, trans-anethole, methyl chavicol, allocimene diepoxide, limonene mono-epoxide, iso-bornyl acetate, nopyl acetate, α-terpinyl acetate, linalyl acetate, geranyl acetate, citronellyl acetate, dihydro-terpinyl acetate and neryl acetate; and (3) terpene aldehydes and ketones, including, for example, myrtenal, campholenic aldehyde, perillaldehyde, citronellal, citral, hydroxy citronellal, camphor, verbenone, carvenone, dihydrocarvone, carvone, piperitone, menthone, geranyl acetone, pseudo-ionone, α-ionone, β-ionone, iso-pseudo-methyl ionone, normal-pseudo-methyl ionone, iso-methyl ionone and normal-methyl ionone. Terpene hydrocarbons with functional groups which appear suitable for use in the present invention are discussed in substantially greater detail by Simonsen and Ross, *The Terpenes*, Volumes I–V, Cambridge University Press, 2nd Ed., 1947, which is incorporated herein in entirety by this reference. See also, commonly assigned U.S. Pat. No. 5,279,758, issued to Choy on Jan. 18, 1994, which is incorporated herein in entirety by this reference.

Method of Preparing

In preparing a composition of the present invention, the components are admixed in a suitable mixing means, in any order of addition, subject to the limitation that the source of divalent ionic calcium is added after the addition of the alumina and before the addition of the surfactant. In practice, the alumina is activated by mixing the alumina with an acid and the resulting activated alumina is then neutralized with sodium hydroxide. Following this neutralization, a halogen bleach is added. Additional components of the inventive composition, for example, a source of divalent ionic calcium, a surfactant, and optional adjuncts, including fragrances or solvents, may be added in any order, although an electrolyte/buffer component is added after the halogen bleach and the surfactant. Preferably, the electrolyte/ buffer compound is added with appropriate mixing to yield a uniform, slightly opaque composition.

Method of Cleaning

In the cleaning of a substrate with the inventive composition, the inventive composition is put in contact with the substrate, such as a surface or a fabric which is soiled, stained, or otherwise in need of cleaning. As described above, the contacting of the substrate with the inventive composition may occur before the actual washing or laundering of the substrate, for example, in a pre-wash application to a stained fabric that is to be washed. Alternately, the contacting of the substrate with the inventive composition may occur during the actual washing or laundering of the substrate.

EXAMPLES

An example of an embodiment of the inventive cleaning composition comprises the components which are listed below as Example 1. The preferred amount of each component is provided in terms of the weight percent of that component relative to the composition. The cleaning composition of Example 1 evidences the advantages of the present invention described herein.

Example 1

| Component | Weight Percent (%) |
|---|---|
| Alumina[1] | 2.57 |
| Hydrochloric Acid (13%) | 0.2229 |
| Sodium Hypochlorite | 1.57 |
| Sodium Hydroxide | 0.80 |
| Lauric Acid | 0.96 |
| Secondary Alkane Sulfonate | 2.50 |
| Amine Oxide[2] | 1.29 |
| Sodium Silicate[3] (47%) | 2.37 |
| Calcium Chloride | 0.07 |
| Fragrance Oil | 0.057 |
| Water | Balance |

[1]CAPATAL D, manufactured by Vista Chemical Company.
[2]LO/CO from Stepan Chemical.
[3]RU, commercially available from PQ Corporation, Valley Forge, Pennsylvania.

Figure 2:
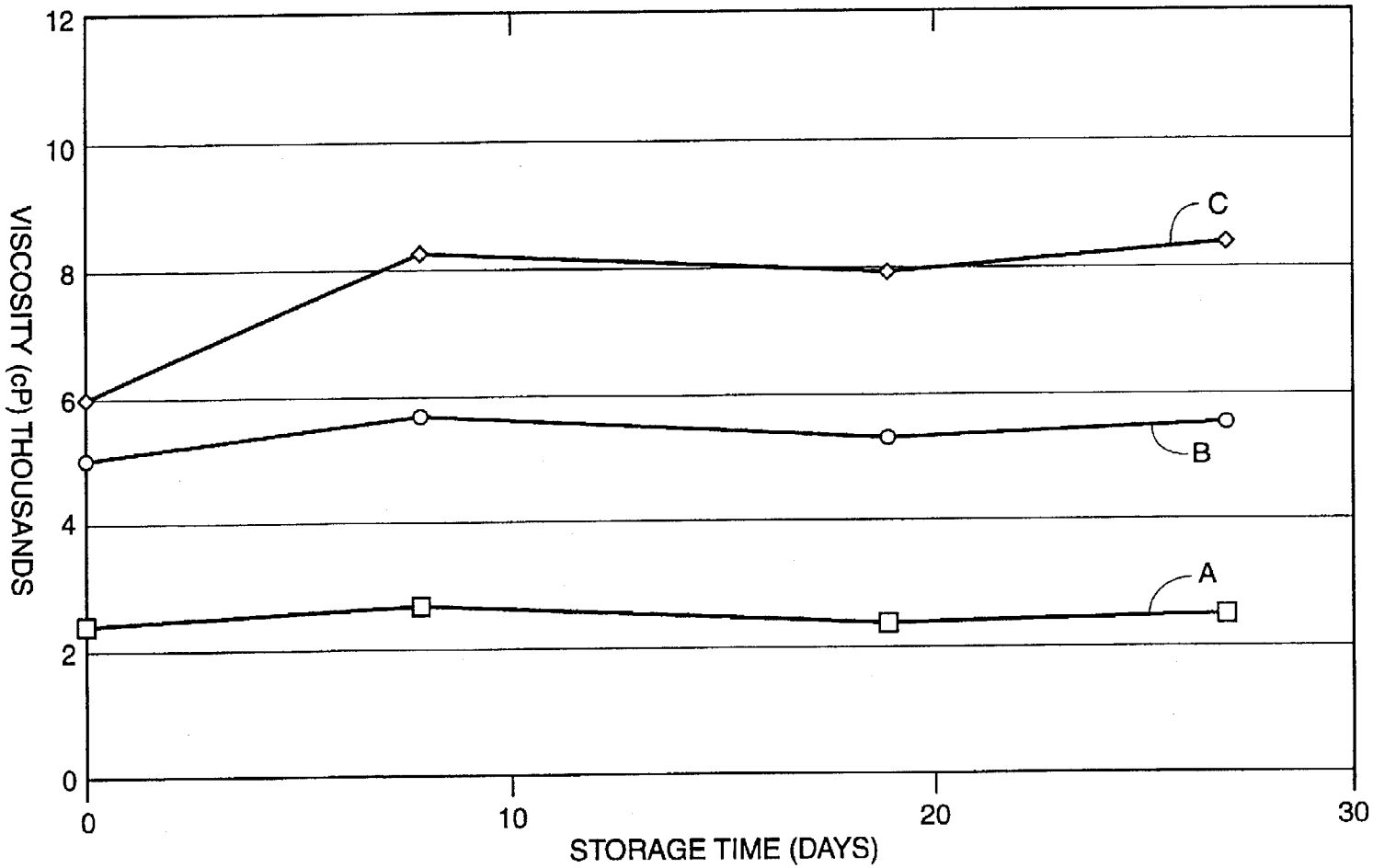
FIG. 2 is a graph showing viscosity stability at 120 degrees Fahrenheit (°F.) for one composition having no ionic calcium, and two compositions having various concentrations of ionic calcium according to the present invention, wherein the ordinate represents viscosity in thousands of centipoise (cP) and the abscissa represents storage time in days.

FIGS. 1 and 2 show viscosity stability at 70 and at 120 degrees Fahrenheit (°F.), respectively, for three formulations, identified as A, B and C, having in common the components listed in Table 1 below. The amount of each of these common components is provided in terms of the weight percent of the component relative to the composition.

TABLE 1

| Component | Weight Percent (%) |
|---|---|
| Alumina[1] | 4.3 |
| Hydrochloric Acid (13%) | 0.55 |
| Sodium Hypochlorite | 1.48 |
| Sodium Hydroxide | 0.56 |
| Lauric Acid | 1.00 |
| Secondary Alkane Sulfonate | 1.2 |
| Amine Oxide[2] | 0.90 |
| Sodium Silicate[3] (47%) | 2.0 |
| Fragrance Oil | 0.06 |
| Water | Balance |

[1]CAPATAL D, manufactured by Vista Chemical Company.
[2]LO/CO from Stepan Chemical.
[3]RU, commercially available from PQ Corporation, Valley Forge, Pennsylvania.

Formulation A contains only the components listed in Table 1 and represents a stain-removing gel which is appropriate for pre-wash treatment in laundry applications. This stain-removing gel contains no additional ionic calcium component. Formulation B additionally contains 0.0007 weight percent ionic calcium, according to the present invention. Formulation C additionally contains 0.07 weight percent ionic calcium, also according to the present invention.

For each formulation, whether stored at 70° F. or at 120° F., viscosity was measured with a Brookfield Model DV2-RV viscometer at 5 rpm at 70° F. (i.e., each formulation stored at 120° F. was cooled to 70° F. for the viscosity measurement). As demonstrated in FIGS. 1 and 2, the inventive formulations B and C have a greater initial viscosity than that of commercial formulation A at both 70° F., which is considered a realistic shelf condition, and at 120° F., which is considered an elevated temperature. The viscosity of the inventive formulations B and C are stable over time, as demonstrated, for example, in FIG. 1 which reflects viscosity at 70° F. over a storage time of about 250 days. The viscosity of the inventive formulations B and C are also stable at increased temperature, as demonstrated, for example, in FIG. 2 which reflects viscosity at 120° F. over a storage time of about 27 days.

Figure 3:
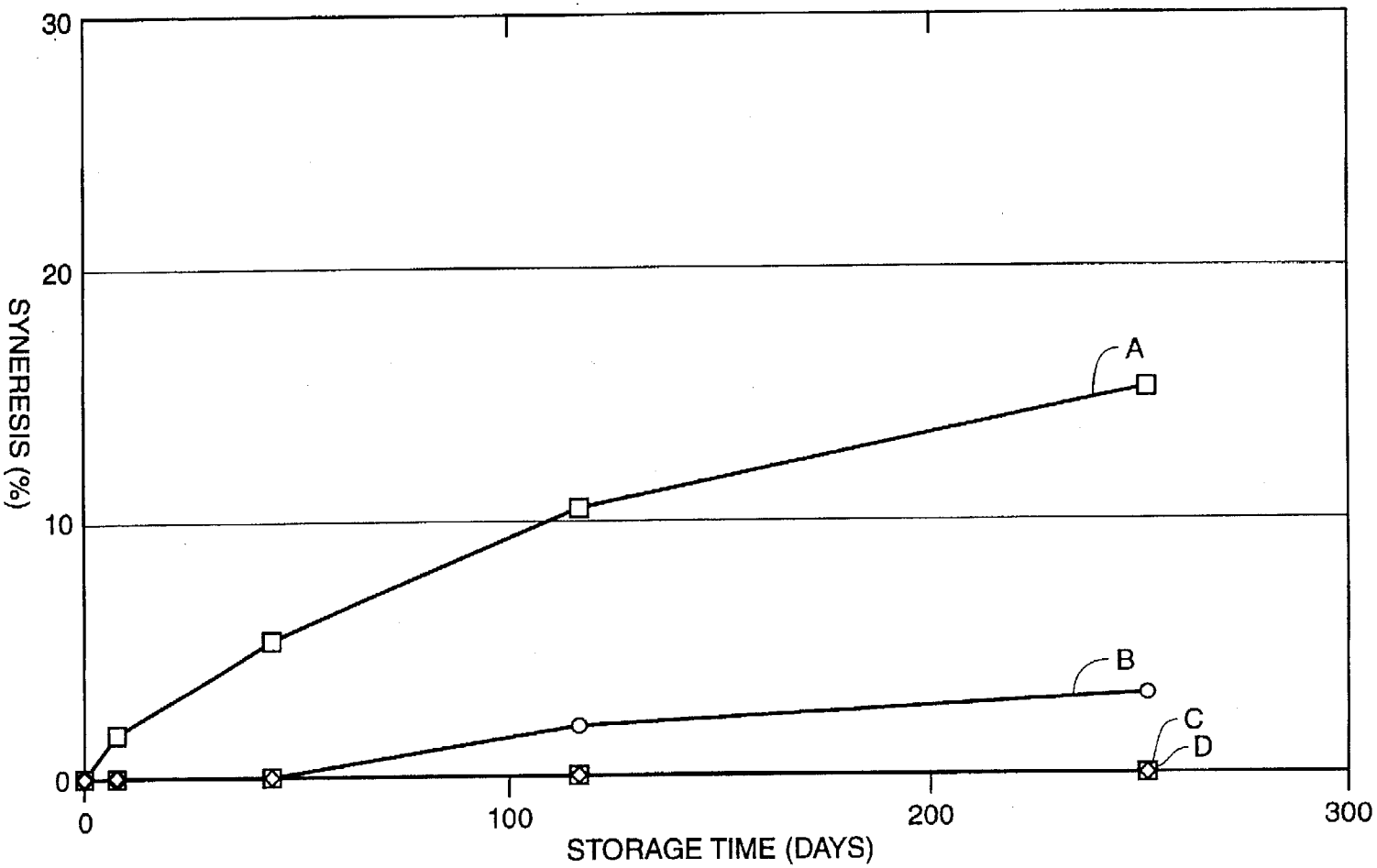
FIG. 3 is a graph showing phase stability at 70 degrees Fahrenheit (°F.) for one composition having no ionic calcium, and three compositions having various concentrations of ionic calcium according to the present invention, wherein the ordinate represents syneresis in percent and the abscissa represents storage time in days.
Figure 4:
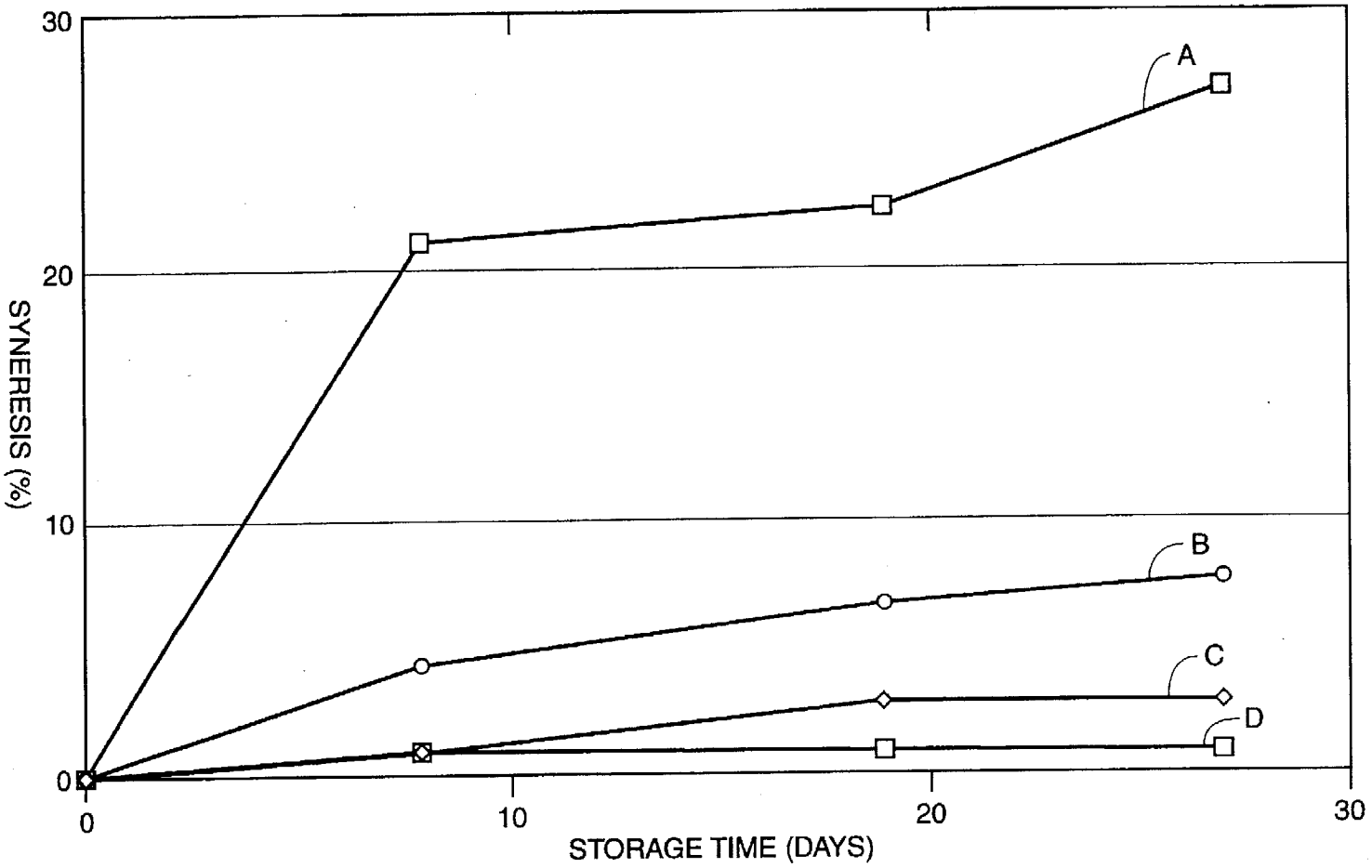
FIG. 4 is a graph showing phase stability at 120 degrees Fahrenheit (°F.) for one composition having no ionic calcium, and three compositions having various concentrations of ionic calcium according to the present invention, wherein the ordinate represents syneresis in percent and the abscissa represents storage time in days.

FIGS. 3 and 4 show phase stability at 70° F. and 120° F., respectively, for commercial formulation A and inventive formulations B and C, as described above. These two figures also show phase stability at 70° F. and 120° F. for a formulation D which contains components in common with formulations A, B and C, as set forth in Table 1 above, and additionally contains 0.35 weight percent ionic calcium, according to the present invention.

As used in terms of FIGS. 3 and 4, phase stability refers to a lack of syneresis in a formulation over time. For each formulation, syneresis was determined by viewing the formulation in a uniform, clear container of plastic (not glass), for example, high density polyethylene, and, with a ruler, measuring the height of the syneresis layer and, if any, the non-syneresis layer.

As demonstrated in FIGS. 3 and 4, formulations C and D show very little, if any, syneresis, formulation B shows little syneresis, while commercial formulation A shows relatively greater syneresis, over time. The phase stability data for the inventive formulations B, C and D are stable over time, as demonstrated, for example, in FIG. 3 which reflects syneresis at 70° F. over a storage time of about 250 days. The phase stability of the inventive formulations B, C and D are also stable at increased temperature over time, as demonstrated, for example, in FIG. 4 which reflects syneresis at 120° F. over a storage time of about 27 days.

Figure 5:
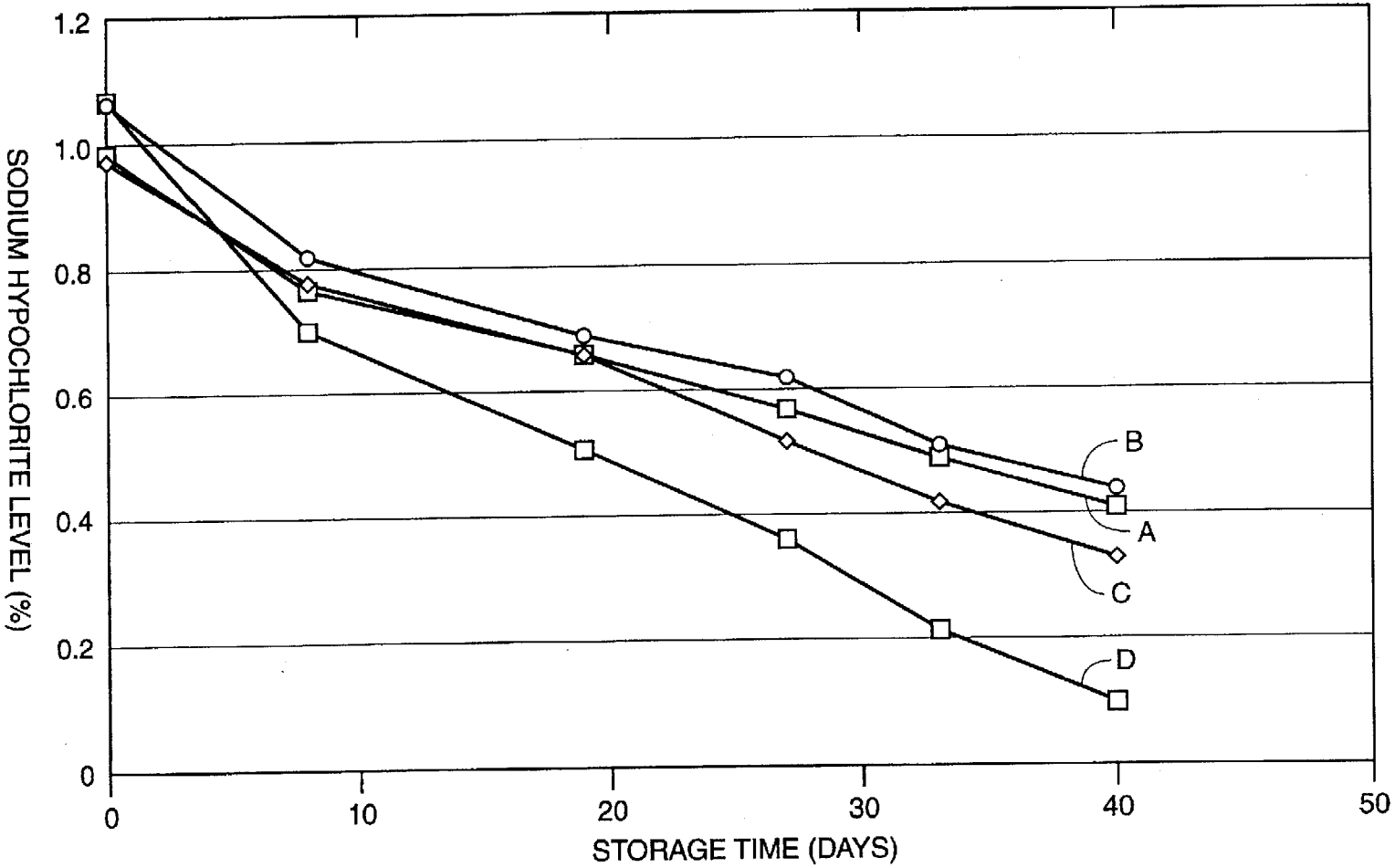
FIG. 5 is a graph showing bleach stability at 120 degrees Fahrenheit (°F.) for one composition having no ionic calcium, and three compositions having various concentrations of ionic calcium according to the present invention, wherein the ordinate represents bleach (sodium hypochlorite) concentration in weight percent of the composition and the abscissa represents storage time in days.

FIG. 5 shows bleach stability at 120° F. for commercial formulation A, and inventive formulations B, C and D, as described above. These four formulations contain a halogen bleach, particularly, sodium hypochlorite, as set forth in Table 1. In formulations A, B, C and D, sodium hydroxide was added to adjust (i.e., raise) the pH of the formulation to an appropriate level (i.e., alkaline) prior to the addition of ionic calcium.

As used in terms of FIG. 5, bleach stability refers to a lack of sodium hypochlorite decomposition, or a lack of reduction in sodium hypochlorite concentration, in a formulation over time. A temperature of 120° F. was used to accelerate data collection, i.e., to collect bleach stability data over a storage time of about 40 days rather than over a prolonged storage time. For each formulation, bleach stability was determined by iodometric titration.

As demonstrated in FIG. 5, formulations A, B and C have similar levels of sodium hypochlorite concentration over time. These levels represent bleach stability appropriate for this invention. Formulation D shows a greater reduction in sodium hypochlorite concentration over time than do formulations A, B and C. It is believed, without being so bound, that ionic calcium at the concentration level of that in inventive formulation D, as compared to formulations A, B and C, interacts somewhat with the bleach, or provides an higher ionic strength, which may cause the greater reduction in sodium hypochlorite concentration over time. This greater reduction in sodium hypochlorite concentration over time associated with formulation D still represents bleach stability appropriate for the present invention.

In three formulations containing the components set forth in Table 1 and an additional ionic magnesium component, in concentrations of 0.007, 0.07 and 0.28 weight percent of the respective formulation, the viscosity stability at 70° F. over about 63 days was not significantly different than that for commercial formulation A. As described in relation to FIG. 1, the initial viscosity of commercial formulation A at 70° F. was not as great as that of the ionic calcium-containing inventive formulations B and C. Thus, the ionic magnesium-containing formulations do not appear to increase initial compositional viscosity, as desired in the present invention.

In the above-described formulations having ionic magnesium concentrations of 0.007 and 0.07 weight percent, respectively, bleach stability at 120° F. over a storage time of about 40 days was not significantly different than that for commercial formulation A, while for the formulation having an ionic magnesium concentration of 0.28 weight percent, bleach stability at this temperature and for this storage period was unacceptably low.

In all of these ionic magnesium-containing formulations, sodium hydroxide was added to adjust (i.e., raise) the formulation pH to an appropriate level (i.e., alkaline) prior to the addition of ionic magnesium, as was done in the ionic calcium-containing formulations. In a first experiment on each of the ionic magnesium-containing formulations, addition of the ionic magnesium resulted in an immediate lowering of the formulation pH and a consequent loss of bleach stability. To determine whether or not the ionic magnesium or the lack of sufficient sodium hydroxide caused this lowering of the pH, a second experiment was conducted for each of the ionic magnesium-containing formulations in which a stoichiometric amount of sodium hydroxide was added to balance the ionic magnesium being subsequently added. In the second experiment, when the ionic magnesium was added, no impact on the bleach stability or the rheological properties of the formulation was observed. It is believed that these first and second experiments demonstrate that the ionic magnesium preferentially ion-pairs with anions, such as hydroxide ions, present in the formulation, thereby lowering the pH and adversely affecting bleach stability. Thus, the ionic magnesium-containing formulations do not appear to provide the bleach stability characteristics of the inventive, ionic calcium-containing formulations.

Importantly, the experimental results demonstrated by, and the mechanisms attributed to, the ionic magnesium-containing formulations, as described above, differ from those demonstrated by, and attributed to, the ionic calcium-containing formulations. For example, in the ionic calcium-containing formulations in which sodium hydroxide is added to adjust the pH, the addition of the ionic calcium does not result in the immediate lowering of the pH and consequent loss of bleach stability. Thus, additional sodium hydroxide, such as that required in the ionic magnesium-containing formulations, is not required in the ionic calcium-containing formulations. In the ionic calcium-containing formulations, the ionic calcium is believed to interact with the alumina, surfactant, and/or electrolyte/buffer components of the formulation to stabilize these components, in preference to interacting with the anions, such as hydroxide ions, present in solution. The ionic calcium-containing formulations are thus considered unique in providing the advantageous viscous and rheological properties of the present invention, without a consequent lowering of the pH of the formulations and adverse effect on bleach stability. Thus, the ionic calcium-containing composition of the present invention provides the unexpected advantageous properties of viscosity stability, rheological stability, phase stability, as well as bleach stability.

In addition to the desirable properties described above, the present invention provides a cleaning composition which exhibits desirable elastic properties. In general, desirable properties of elasticity for a thickened cleaning composition are demonstrated when the ratio of the storage modulus (G') to the loss modulus (G") is high, as a higher ratio of G' to G" is associated with increased phase stability. The observed increase in the G':G" ratio of a composition of a given viscosity indicates improved compositional elasticity as well as improved phase stability. In the inventive cleaning composition, the ratio of G' to G" increases with increased concentration of ionic calcium. Thus, compositions of the present invention having increased calcium concentration demonstrate improved phase stability.

Additionally, in the inventive cleaning composition, the yield stress value, which is the amount of stress applied to the system to induce flow, increases with increased concentration of ionic calcium. In general, for thickened aqueous cleaning compositions, a lower yield stress value indicates that less effort is needed to induce flow of the composition. For appropriate dispensibility of a thickened aqueous cleaning composition, the composition should be neither too non-resistant nor too resistant to flow. The yield stress value of the inventive cleaning composition, with its viscosity- and phase-stabilizing amount of ionic calcium, remains at a level desirable for thickened aqueous cleaning compositions. Thus, the present invention provides a cleaning composition having desirable viscosity, phase stability and dispensibility characteristics.

Inventive formulations B, C and D, as described above, further demonstrate desirable shear-thinning properties, as determined by a shear-thinning profile, or plot of viscosity versus shear rate (not shown). Generally, the shear-thinning profile provides an indication of how the formulation thins when it is pressured through an orifice, yet another indication of dispensibility. The shear-thinning profiles for inventive formulations B, C and D were higher than that for commercial formulation A, although not significantly in terms of the dispensibility desirable for a thickened aqueous cleaning composition. The shear-thinning profiles for inventive formulations B and C were lower than that for inventive formulation D, indicative of the more desirable dispensibility of the two inventive formulations B and C relative to the relatively lower, but still desirable, dispensibility of inventive formulation D. The present invention thus provides a cleaning composition having good dispensibility characteristics.

The experimental data show that the composition of the present invention has excellent viscosity and rheological properties, as well as viscosity stability, rheological stability, phase stability and bleach stability. These advantageous characteristics of the inventive composition are maintained under typical storage conditions and over extended times and at elevated temperatures.

It is to be understood that while the invention has been described above in conjunction with preferred specific embodiments, the description and examples are intended to illustrate and not to limit the scope of the invention, which is defined by the scope of the appended claims.

It is claimed:

1. An alkaline, abrasive-free, cleaning composition, comprising, in aqueous solution:

from about 0.1 to about 10 weight percent of the composition of a colloidal aluminum oxide thickener;

from about 0.1 to about 20 weight percent of the composition of at least one surfactant, the surfactant alone, or a plurality of surfactants together, effective to provide cleaning activity and, in association with said alumina thickener, thickening;

from about 0.1 to about 25 weight percent of the composition of an electrolyte/buffer effective to promote an environment in which said alumina thickener and said at least one surfactant associate to provide thickening;

from about 0.1 to about 15 weight percent of the composition of a halogen bleach; and, a substantially water soluble source of divalent ionic calcium, said source providing ionic calcium in an amount from about 0.0001 to about 1.0 weight percent of the composition.

2. The composition of claim 1 wherein the halogen bleach is selected from the group consisting of the alkali metal and alkaline earth salts of hypohalite, hypohalite addition products, haloamines, haloimines, haloamides and haloimides.

3. The composition of claim 1 wherein the electrolyte/buffer is selected from the group consisting of phosphates, polyphosphates, pyrophosphates, triphosphates, tetraphosphates, silicates, metasilicates, polysilicates, carbonates, hydroxides; alkali metal salts thereof; and mixtures thereof.

4. The composition of claim 1 wherein the source of divalent ionic calcium is calcium chloride.

5. The composition of claim 1 wherein the amount of ionic calcium is from about 0.0007 to about 0.07 weight percent of the composition.

6. The composition of claim 1 wherein the surfactant is selected from the group consisting of anionic, non-ionic, amphoteric, zwitterionic surfactants, and mixtures thereof.

7. The composition of claim 6 wherein the surfactant is an anionic surfactant selected from the group consisting of alkali metal alkyl sulfates, secondary alkane sulfonates, alkyldiphenyl ether disulfonates, and mixtures thereof.

8. The composition of claim 6 wherein the surfactant is an amine oxide.

9. The composition of claim 6 wherein the surfactant comprises a mixture of anionic and bleach-stable non-ionic surfactants.

10. The composition of claim 9 wherein the anionic surfactant is a secondary alkane sulfonate and the bleach-stable non-ionic surfactant is an amine oxide.

11. The composition of claim 1 further comprising a $C_{6-14}$ soap.

12. The composition of claim 11 wherein the $C_{6-14}$ soap is an alkali metal soap of lauric acid.

13. The composition of claim 1 wherein the amount of ionic calcium is from about 0.0007 to about 0.07 weight percent of the composition.

14. The composition of claim 1 further comprising an additive selected from the group consisting of a dye, pigment, colorant, whitener, fragrance, solvent, chelating agent, builder, and mixtures thereof.

15. An alkaline, abrasive-free, cleaning composition, comprising, in aqueous solution:

from about 0.1 to about 10 weight percent of the composition of a colloidal aluminum oxide thickener;

from about 0.1 to about 20 weight percent of the composition of at least one surfactant, the surfactant alone, or a plurality of surfactants together, effective to provide cleaning activity and, in association with said alumina thickener, thickening;

from about 0.1 to about 25 weight percent of the composition of an electrolyte/buffer effective to promote an environment in which said alumina thickener and said at least one surfactant associate to provide thickening;

from about 0.1 to about 15 weight percent of the composition of a halogen bleach;

a fatty acid soap; and, a substantially water soluble source of divalent ionic calcium, said source providing ionic calcium in an amount from about 0.0001 to about 1.0 weight percent of the composition.

16. The composition of claim 15 wherein the halogen bleach is selected from the group consisting of the alkali metal and alkaline earth salts of hypohalite, hypohalite addition products, haloamines, haloimines, haloamides and haloimides.

17. The composition of claim 15 wherein the electrolyte/buffer is selected from the group consisting of phosphates, polyphosphates, pyrophosphates, triphosphates, tetraphosphates, silicates, metasili-cates, polysilicates, carbonates, hydroxides; alkali metal salts thereof; and mixtures thereof.

18. The composition of claim 15 wherein the surfactant comprises a mixture of anionic and bleach-stable non-ionic surfactants.

19. The composition of claim 18 wherein the anionic surfactant is a secondary alkane sulfonate and the bleach-stable non-ionic surfactant is an amine oxide.

20. The composition of claim 15 wherein the fatty acid soap is an alkali metal soap of lauric acid.

21. The composition of claim 15 wherein the source of divalent ionic calcium is calcium chloride.

22. The composition of claim 15 wherein the amount of ionic calcium is from about 0.0007 to about 0.07 weight percent of the composition.

23. The composition of claim 15 wherein the fatty acid soap is present in an amount up to about 10 weight percent of the composition.

24. The composition of claim 15 further comprising an additive selected from the group consisting of a dye, pigment, colorant, whitener, fragrance, solvent, chelating agent, builder, and mixtures thereof.

25. A method of cleaning a substrate, comprising contacting a substrate with an alkaline, abrasive-free, cleaning composition which comprises, in aqueous solution, from about 0.1 to about 10 weight percent of the composition of a colloidal aluminum oxide thickener; from about 0.1 to about 20 weight percent of the composition of at least one surfactant, the surfactant alone, or a plurality of surfactants together, effective to provide cleaning activity and, in association with said alumina thickener, thickening; from about 0.1 to about 25 weight percent of the composition of an electrolyte/buffer effective to promote an environment in which said alumina thickener and said at least one surfactant associate to provide thickening; from about 0.1 to about 15 weight percent of the composition of a halogen bleach; a fatty acid soap; and, a substantially water soluble source of divalent ionic calcium, said source providing ionic calcium in an amount from about 0.0001 to about 1.0 weight percent of the composition.

26. The method of claim 25 wherein the substrate is a hard surface which is soiled or stained.

27. The method of claim 25 wherein the substrate is a fabric which is soiled or stained.

28. The method of claim 25 wherein said contacting the substrate with the composition occurs before washing or laundering the substrate.

29. A method of preparing an alkaline, abrasive-free cleaning composition, comprising combining, in aqueous solution, from about 0.1 to about 10 weight percent of the composition of a colloidal aluminum oxide thickener; from about 0.1 to about 20 weight percent of the composition of at least one surfactant, the surfactant alone, or a plurality of surfactants together, effective to provide cleaning activity and, in association with said alumina thickener, thickening; from about 0.1 to about 25 weight percent of the composition of an electrolyte/buffer effective to promote an environment in which said alumina thickener and said at least one surfactant associate to provide thickening; from about 0.1 to about 15 weight percent of the composition of a halogen bleach; a fatty acid soap; and, a substantially water soluble source of divalent ionic calcium, said source providing ionic calcium in an amount from about 0.0001 to about 1.0 weight percent of the composition.

* * * * *